US011546697B2

(12) United States Patent
Zhang et al.

(10) Patent No.: US 11,546,697 B2
(45) Date of Patent: Jan. 3, 2023

(54) BALANCED ARMATURE TYPE SPEAKER

(71) Applicant: Lanto Electronic Limited, Kunshan (CN)

(72) Inventors: Zhiqiang Zhang, Kunshan (CN); Hongmei Ma, Kunshan (CN)

(73) Assignee: LANTO ELECTRONIC LIMITED, Kunshan (CN)

( * ) Notice: Subject to any disclaimer, the term of this patent is extended or adjusted under 35 U.S.C. 154(b) by 0 days.

(21) Appl. No.: 17/325,753

(22) Filed: May 20, 2021

(65) Prior Publication Data

US 2021/0368278 A1 Nov. 25, 2021

(30) Foreign Application Priority Data

May 21, 2020 (CN) ..... 202010429359.6

(51) Int. Cl.

| | |
|---|---|
| ***H04R 11/02*** | (2006.01) |
| ***H04R 1/02*** | (2006.01) |
| ***H04R 3/00*** | (2006.01) |
| ***H04R 7/12*** | (2006.01) |
| ***H04R 7/18*** | (2006.01) |

(52) U.S. Cl.

CPC ..... *H04R 11/02* (2013.01); *H04R 1/023* (2013.01); *H04R 1/025* (2013.01); *H04R 3/00* (2013.01); *H04R 7/127* (2013.01); *H04R 7/18* (2013.01)

(58) Field of Classification Search

CPC ..... H04R 11/02; H04R 1/023; H04R 1/025; H04R 3/00; H04R 7/127; H04R 7/18

USPC ..... 381/117

See application file for complete search history.

(56) References Cited

U.S. PATENT DOCUMENTS

| | | | | |
|---|---|---|---|---|
| 10,972,830 | B1 * | 4/2021 | Huang | H04R 3/14 |
| 2009/0304225 | A1 | 12/2009 | Kamimura et al. | |
| 2013/0328648 | A1 * | 12/2013 | Kuivallainen | H04B 1/38 335/219 |

(Continued)

FOREIGN PATENT DOCUMENTS

| | | |
|---|---|---|
| CN | 203872027 U | 10/2014 |
| CN | 204465856 U | 7/2015 |

(Continued)

OTHER PUBLICATIONS

Translation of CN204465856U; Hu et al.; Jul. 8, 2015.*

(Continued)

*Primary Examiner* — Andrew L Sniezek

(74) *Attorney, Agent, or Firm* — Birch, Stewart, Kolasch & Birch, LLP

(57) ABSTRACT

Provided is a balanced armature type speaker. The balanced armature type speaker includes a housing, a driving assembly and a diaphragm. The housing includes an upper inner cavity and a lower inner cavity, the lower inner cavity and the upper inner cavity are through from top to bottom, the driving assembly is located in the lower inner cavity, and the driving assembly includes a magnet, a coil, an armature and an ejector pin. The armature is inserted into the magnet and the coil sequentially, the ejector pin is fixedly connected to the armature and the diaphragm, and the diaphragm is located in the upper inner cavity. The housing is shaped to be wide at the upper part and narrow at the lower part, and in the horizontal direction, a width of the upper inner cavity is larger than a width of the lower inner cavity.

18 Claims, 4 Drawing Sheets

(56) References Cited

U.S. PATENT DOCUMENTS

2015/0078934 A1* 3/2015 Lucas ..... F04B 43/04
417/413.1

FOREIGN PATENT DOCUMENTS

| | | | |
|---|---|---|---|
| CN | 105681981 | A | 6/2016 |
| CN | 205491122 | U | 8/2016 |
| CN | 106101959 | A | 11/2016 |
| CN | 205961439 | U | 2/2017 |
| CN | 207070350 | U | 3/2018 |
| CN | 208739418 | U | 4/2019 |
| CN | 111131977 | A | 5/2020 |
| GB | 547728 | A | 9/1942 |
| GB | 603418 | A | 6/1948 |
| KR | 10-2018-0085393 | A | 7/2016 |
| KR | 10-1738135 | B1 | 6/2017 |
| WO | WO 2013/079930 | A2 | 6/2013 |
| WO | WO 2019/128425 | A | 7/2019 |

OTHER PUBLICATIONS

First Office Action issued in Chinese Application No. 202010423353.6, dated Nov. 3, 2020.
Search Report issued in Chinese Application No. 202010429359.6, dated May 21, 2020.
The Second Office Action issued in Chinese Application No. 202010429359.6, dated Feb. 23, 2021.
Danish Office Action and Search Report for Danish Application No. PA202170255, dated Nov. 18, 2021.

* cited by examiner

BALANCED ARMATURE TYPE SPEAKER

CROSS-REFERENCE TO RELATED APPLICATION

This application claims priority to Chinese Patent Application No. 202010429359.6 filed May 21, 2020, the disclosure of which is incorporated herein by reference in its entirety.

TECHNICAL FIELD

The present disclosure relates to a field of balanced armature type electroacoustic technologies and, in particular, to a balanced armature type speaker.

BACKGROUND

At present, most speakers on the market are divided into two types of speakers. One kind of speaker uses a coil to drive a diaphragm to generate sound, and is called as a moving-coil speaker. Another kind of speaker uses an armature (metal sheet) to drive a diaphragm to generate sound, and is called as a moving-iron speaker. With the development of science and technology, music earphones and wearable devices have become increasingly miniaturized and thinned in recent years. People have higher and higher performance requirements for these electronic products, so that the volume of electronic parts matching with the electronic products is required to be reduced, and the performance consistency is required to be improved constantly. The speaker is an important component widely used in the above electronic products, so on the basis of ensuring the performance of the speaker, the volume of the speaker is required to be minimized in order to meet the needs of miniaturization and microminiaturization of new electronic devices. The shape of the existing moving-iron speaker generally is a regular rectangle or circle, and the output and volume ratio are not optimal.

SUMMARY

The present disclosure provides a balanced armature type speaker which has a high output volume ratio.

To realize the above object, the present disclosure adopts the following technical solutions. A balanced armature type speaker includes a housing, a driving assembly and a diaphragm. The housing includes an upper inner cavity and a lower inner cavity, the lower inner cavity and the upper inner cavity are through from top to bottom, the driving assembly is located in the lower inner cavity, the driving assembly includes a magnet, a coil, an armature and an ejector pin. The armature is inserted into the magnet and the coil sequentially, the ejector pin is fixedly connected to the armature and the diaphragm, and the diaphragm is located in the upper inner cavity. The housing is shaped to be wide at the upper part of the housing and narrow at the lower part of the housing, and a width of the upper inner cavity in a horizontal direction is larger than a width of the lower inner cavity in the horizontal direction.

As a further improved technical solution of the present disclosure, in at least one of a left-right direction or a front-back direction, a width of the upper inner cavity is larger than a width of the lower inner cavity, and the upper inner cavity is shaped as a circle, a square or a runway.

As a further improved technical solution of the present disclosure, the housing includes a median septum, an upper side wall extending upward from an outer periphery of the median septum, and several lower side walls extending downward. The upper inner cavity is between the median septum and the upper side wall, and the lower inner cavity is between the median septum and the lower side walls.

As a further improved technical solution of the present disclosure, the median septum has an inner hole communicating with the upper inner cavity and the lower inner cavity, and the lower side walls are formed by extending downward from an inner edge of the inner hole.

As a further improved technical solution of the present disclosure, the upper side wall is coplanar with at least one of the lower side walls.

As a further improved technical solution of the present disclosure, four lower side walls are provided. Three of the four lower side walls are shaped as a vertical plate and the other lower side wall is shaped as an arc.

As a further improved technical solution of the present disclosure, the balanced armature type speaker further includes a cover body. The cover body includes a cover plate and a support ring disposed on a lower surface of the cover plate, the cover plate covers a top of the upper inner cavity, and the cover plate is provided with a sound outlet hole. The diaphragm includes a dome, a folded ring part and an outer ring part. The folded ring part is connected between the dome and the outer ring part, and the outer ring part is clamped and fixed between the support ring and the housing.

As a further improved technical solution of the present disclosure, an outer side surface of the upper side wall is coplanar with an outer side surface of the housing.

As a further improved technical solution of the present disclosure, the balanced armature type speaker further includes a vibration plate fixed to a lower surface of the dome.

As a further improved technical solution of the present disclosure, the balanced armature type speaker further includes a washer surrounding the sound outlet hole and a dust screen covering the sound outlet hole. The dust screen is fixed on the washer.

As a further improved technical solution of the present disclosure, the balanced armature type speaker further includes a printed circuit board, which is fixed to the housing and covers a bottom of the lower inner cavity.

DETAILED DESCRIPTION

Figure 1:
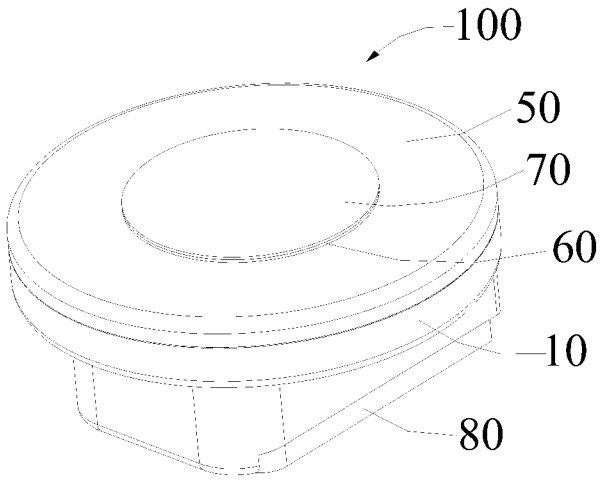
FIG. 1 is a perspective view of a balanced armature type speaker of the present disclosure.
Figure 2:
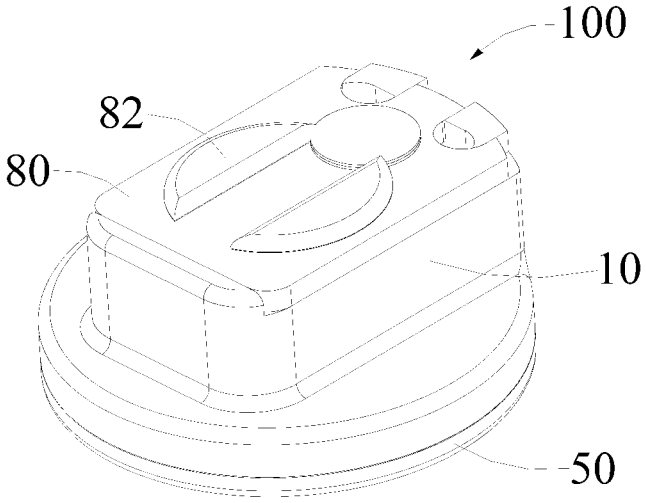
FIG. 2 is a perspective view of a balanced armature type speaker of the present disclosure from another perspective.

Referring to FIGS. 1 to 6, the present disclosure discloses a balanced armature type speaker 100, which includes a housing 10, a driving assembly 20, a diaphragm 30, a vibration plate 40, a cover body 50, a washer 60, a dust screen 70, and a printed circuit board 80.

The housing 10 is made of a metal material or an insulating material, and presents as a hollow structure which is through from top to bottom. The housing 10 is shaped to be wide at the upper part thereof and narrow at the lower part thereof. The housing 10 includes an upper inner cavity 11 and a lower inner cavity 12, the upper inner cavity 11 and the lower inner cavity 12 are through from top to bottom, the upper inner cavity 11 shaped as a circle, a square or a runway. A width of the upper inner cavity 11 is larger than a width of the lower inner cavity 12 in a horizontal direction, and the horizontal direction is a left-right direction or/and a front-back direction, so that the housing 10 is shaped to be wide at the upper part thereof and narrow at the lower part thereof. The housing 10 includes a horizontal median septum 131, an annular upper side wall 132 extending upwardly from an outer periphery of the median septum 131, and several lower side walls 133. The upper inner cavity 11 is between the median septum 131 and the upper side wall 132, and the lower inner cavity 12 is between the median septum 131 and the lower side walls 133. The median septum 131 has an inner hole 14 communicating with the upper inner cavity 11 and the lower inner cavity 12, and the lower side walls 133 are formed by extending downwardly from an inner edge of the inner hole 14. Four lower side walls 133 are provided, three of the four lower side walls 133 are shaped as a vertical plate and the other lower side wall 133 is shaped as an arc. In another embodiment, the upper side wall 132 may be shaped as a square, a runway, or in another regular or irregular shape.

Figure 3:
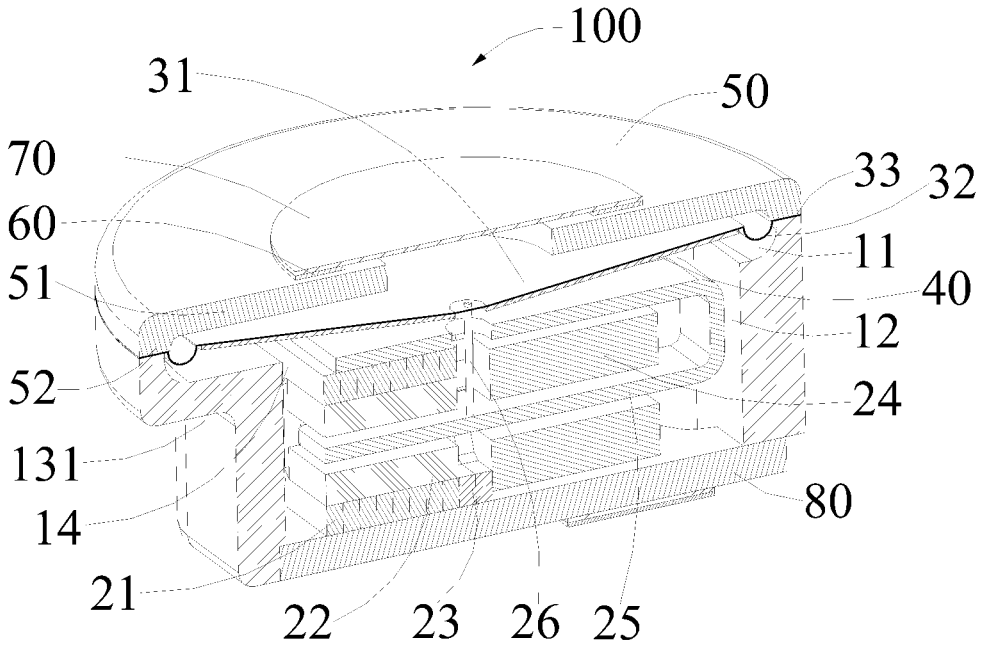
FIG. 3 is a sectional view of a balanced armature type speaker of the present disclosure.
Figure 4:
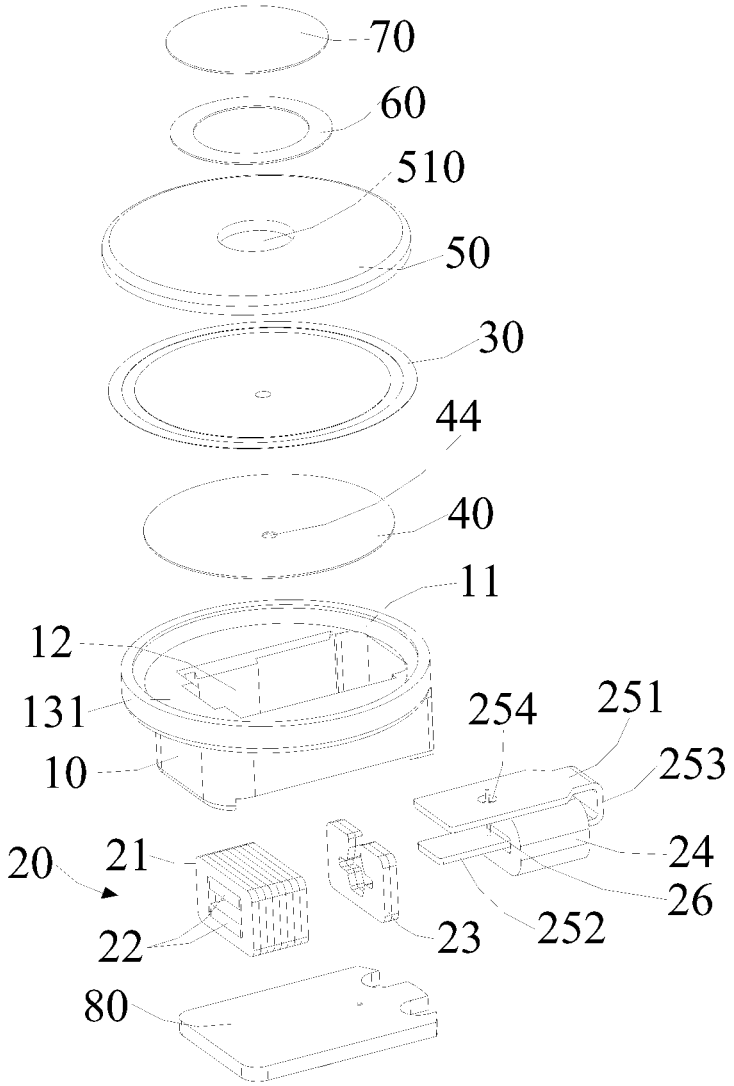
FIG. 4 is a perspective exploded view of a balanced armature type speaker of the present disclosure.
Figure 5:
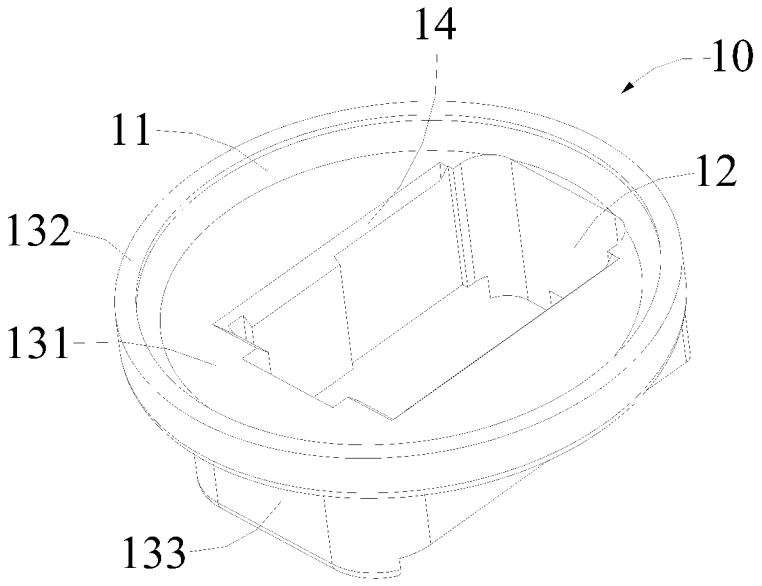
FIG. 5 is a perspective view of a housing of a balanced armature type speaker of the present disclosure.
Figure 6:
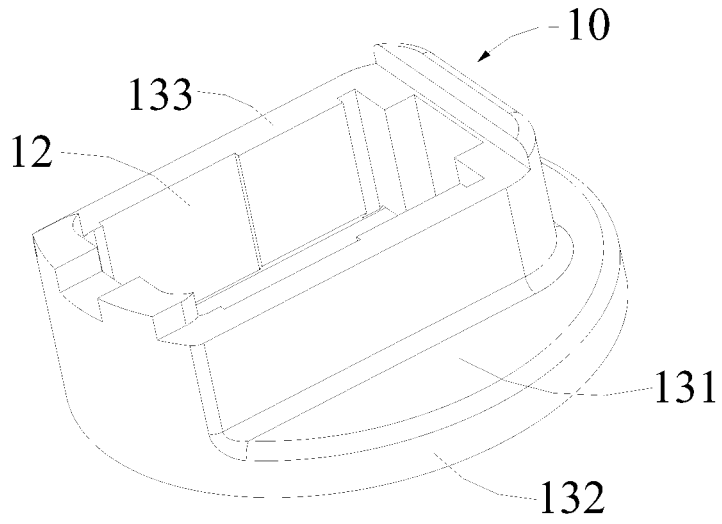
FIG. 6 is a perspective view of a housing of a balanced armature type speaker of the present disclosure from another perspective.

Referring to FIGS. 3 and 4, the driving assembly 20 is fixed in the lower inner cavity 12 of the housing 10 and includes an iron core 21, a magnet 22, a fall guarding piece 23, a coil 24, an armature 25, and an ejector pin 26. The iron core 21 is shaped to be annular. Two magnets 22 are provided, and are fixed and received in the iron core 21 in a manner of being opposite to each other in an up-down direction. The fall guarding piece 23 is disposed between the iron core 21 and the coil 24. The armature 25 passes through the fall guarding piece 23. In a case where the balanced armature type speaker 100 falls from a high altitude, the armature 25 is prevented from colliding with the magnet 22. The armature 25 is provided to be C-shaped and includes an upper sheet 251, a lower sheet 252 opposite to the upper sheet 251, and a side sheet 253 connecting the upper sheet 251 to the lower sheet 252. The upper sheet 251 is located above the iron core 21, the fall guarding piece 23 and the coil 24, and is bonded or laser welded to upper surfaces of the iron core 21 and the fall guarding piece 23. The lower sheet 252 passes through the coil 24, the fall guarding piece 23, and the magnet 22 sequentially. The ejector pin 26 is placed vertically, and an upper end of the ejector pin 26 is fixedly connected to the diaphragm 30, and a lower end of the ejector pin 26 is fixedly connected to the lower sheet 252. The upper sheet 251 is provided with a through hole 254 for the ejector pin 26 to pass through. When the coil 24 is energized to generate a magnetic field, the lower sheet 252 located in the coil 24 is magnetized to generate a magnetic pole, and a magnetic force between the magnetic pole and the magnet 22 is formed to drive the lower sheet 252 to vibrate up and down. Then, the ejector pin 26 follows the lower sheet 252 to move up and down, and drives the diaphragm 30 to vibrate, thereby pushing the air around the diaphragm 30 to move, so that the sound is restored.

The diaphragm 30 includes a dome 31, a folded ring part 32, and an outer ring part 33, and the folded ring part 32 is connected between the dome 31 and the outer ring part 33. The outer ring part 33 is fixed to the upper end of the upper side wall 132 of the housing 10.

The vibration plate 40 is attached to a lower surface of the dome 31 of the diaphragm 30 to increase the vibration sense of the diaphragm 30. The vibration plate 40 is also provided with a through hole 44 for the ejector pin 26 to pass through.

A cover body 50 is integrally formed, and includes a cover plate 51 and a support ring 52 disposed on a lower surface of the cover plate 51. The cover plate 51 covers a top of the upper inner cavity 11. A middle part of the cover plate 51 is provided with a sound outlet hole 510. The support ring 52 is pressed downward on the outer ring part 33 of the diaphragm 30, so that the outer ring part 33 is clamped and fixed by the support ring 52 and the upper side wall 132, and an outer side surface of the support ring 52 is coplanar with an outer side surface of the housing 10, improving the appearance of the balanced armature type speaker 100. In another embodiment, the cover plate 51 and the support ring 52 are disposed separately and then fixed together.

The washer 60 is fixed to an upper surface of the cover body 50 and surrounds the sound outlet hole 510, and the dust screen 70 is fixed on the washer 60 to prevent dust, impurities, or the like from entering the balanced armature type speaker 100.

The printed circuit board 80 is fixed on the lower side walls 133 of the housing 10 to cover a bottom of the lower inner cavity 12. The coil 24 of the driving assembly 20 is electrically connected to the printed circuit board 80. A lower surface of the printed circuit board 80 is provided with a pad 82 for connecting to an external power source which provides power to the driving assembly 20.

The housing 10 of the balanced armature type speaker 100 in the present disclosure is shaped to be wide at the upper part of the housing and narrow at the lower part of the housing. The width of the upper inner cavity 11 is larger than the width of the lower inner cavity 12 in the horizontal direction. In a case of ensuring that the upper inner cavity 11 provides a vibration space required by the diaphragm 30, the output volume ratio is improved, and although the width of the lower inner cavity 12 is reduced, mounting the driving assembly 20 in the lower inner cavity 12 is not affected, thus helping to reduce the volume of the balanced armature type speaker 100, reducing the occupied space of the balanced armature type speaker 100 in the electronic device to facilitate providing the extra space for other components by the electronic device, and to adapt the development trend of miniaturization and microminiaturization of new electronic devices. The diaphragm 30 is completely located in the upper inner cavity 11 to maximize an area of the diaphragm 30 in the upper inner cavity 11, so that the diaphragm 30 can push air of the largest area, thereby increasing the maximum power of the balanced armature type speaker 100.

The above embodiment is only used to explain the present disclosure and not to be construed as the limitation to the technical solutions of the present disclosure. Understanding of the Description, such as the orientation description indicated by terms "front", "back"," "left", "right", "top", "bottom", should be on the basis of those skilled in the art. Although the present disclosure is described herein in detail with reference to the above embodiments, those of ordinary skill in the art shall understand that modifications or equivalent substitutions can be made, and all technical solutions and improvements without departing from the spirit and scope of the present disclosure should fall within the scope of the claims of the present disclosure.

What is claimed is:

1. A balanced armature type speaker, comprising:

a housing, which defines an upper inner cavity and a lower inner cavity, the lower inner cavity and the upper inner cavity being through from top to bottom;

a driving assembly, which is located in the lower inner cavity and comprises a magnet, a coil, an armature and an ejector pin, the armature being inserted into the magnet and the coil sequentially;

a diaphragm, which is located in the upper inner cavity and comprises a dome, a folded ring part and an outer ring part, the folded ring part being connected between the dome and the outer ring part, and the ejector pin being fixedly connected to the armature and the diaphragm; and a cover body, which covers a top of the upper inner cavity, wherein the housing is shaped to be wide at an upper part of the housing and narrow at a lower part of the housing, and in the horizontal direction, a width of the upper inner cavity is larger than a width of the lower inner cavity;

wherein the outer ring part is clamped and fixed between the cover body and the housing;

wherein the housing comprises a median septum, an upper side wall extending upward from an outer periphery of the median septum, and several lower side walls extending downward; wherein the upper inner cavity is between the median septum and the upper side wall, and the lower inner cavity is between the median septum and the lower side walls; and wherein four lower side walls are provided, wherein three of the four lower side walls are shaped as a vertical plate and the other lower side wall is shaped as an arc.

2. The balanced armature type speaker of claim 1, wherein in at least one of a left-right direction or a front-back direction, a width of the upper inner cavity is larger than a width of the lower inner cavity, and the upper inner cavity is shaped as a circle, a square or a runway.

3. The balanced armature type speaker of claim 2, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

4. The balanced armature type speaker of claim 2, further comprising: a printed circuit board, which is fixed to the housing and covers a bottom of the lower inner cavity.

5. The balanced armature type speaker of claim 1, wherein the median septum has an inner hole communicating with the upper inner cavity and the lower inner cavity, and the lower side walls are formed by extending downward from an inner edge of the inner hole.

6. The balanced armature type speaker of claim 5, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

7. The balanced armature type speaker of claim 5, further comprising: a printed circuit board, which is fixed to the housing and covers a bottom of the lower inner cavity.

8. The balanced armature type speaker of claim 1, wherein the upper side wall is coplanar with at least one of the lower side walls.

9. The balanced armature type speaker of claim 8, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

10. The balanced armature type speaker of claim 8, further comprising: a printed circuit board, which is fixed to the housing and covers a bottom of the lower inner cavity.

11. The balanced armature type speaker of claim 1, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

12. The balanced armature type speaker of claim 11, wherein an outer side surface of the upper side wall is coplanar with an outer side surface of the housing.

13. The balanced armature type speaker of claim 11, further comprising: a vibration plate fixed to a lower surface of the dome.

14. The balanced armature type speaker of claim 11, further comprising: a washer surrounding the sound outlet hole, and a dust screen covering the sound outlet hole, wherein the dust screen is fixed on the washer.

15. The balanced armature type speaker of claim 1, further comprising: a printed circuit board, which is fixed to the housing and covers a bottom of the lower inner cavity.

16. The balanced armature type speaker of claim 1, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

17. The balanced armature type speaker of claim 1, wherein the cover body comprises a cover plate and a support ring disposed on a lower surface of the cover plate, the cover plate covers the top of the upper inner cavity and is provided with a sound outlet hole, and the outer ring part is clamped and fixed between the support ring and the housing.

18. The balanced armature type speaker of claim 1, further comprising: a printed circuit board, which is fixed to the housing and covers a bottom of the lower inner cavity.

* * * * *